US009078526B1

(12) United States Patent
Kammeyer

(10) Patent No.: US 9,078,526 B1
(45) Date of Patent: Jul. 14, 2015

(54) UNIVERSAL BUCKET SEAT

(71) Applicant: Roger W. Kammeyer, Concordia, MO (US)

(72) Inventor: Roger W. Kammeyer, Concordia, MO (US)

( * ) Notice: Subject to any disclaimer, the term of this patent is extended or adjusted under 35 U.S.C. 154(b) by 0 days.

(21) Appl. No.: 14/492,213

(22) Filed: Sep. 22, 2014

Related U.S. Application Data

(60) Provisional application No. 61/888,659, filed on Oct. 9, 2013.

(51) Int. Cl.
*A47C 13/00* (2006.01)
*A47C 9/00* (2006.01)
*A47C 4/02* (2006.01)

(52) U.S. Cl.
CPC ..... *A47C 13/00* (2013.01); *A47C 4/021* (2013.01); *A47C 9/00* (2013.01)

(58) Field of Classification Search
CPC ..... A01K 97/22; A47C 9/00; A47C 13/00
USPC ..... 297/452.1, 452.48, 179, 175, 195.11, 297/461.1, 461, 462, 134, 188.08, 188.09, 297/423.41; 220/212; 206/223
See application file for complete search history.

(56) References Cited

U.S. PATENT DOCUMENTS

| | | | | | |
|---|---|---|---|---|---|
| 3,695,742 | A | * | 10/1972 | Allen | 312/237 |
| 3,751,845 | A | * | 8/1973 | van Leeuwen | 43/56 |
| 3,797,695 | A | * | 3/1974 | Law | 297/188.1 |
| 4,295,680 | A | * | 10/1981 | Grasso | 297/188.09 |
| 4,379,587 | A | | 4/1983 | Duncan | |
| 4,845,881 | A | * | 7/1989 | Ward | 43/21.2 |
| D321,991 | S | * | 12/1991 | Menges et al. | D6/335 |
| 5,503,460 | A | * | 4/1996 | Yu | 297/461 |
| 7,341,314 | B1 | * | 3/2008 | Boyd | 297/467 |
| 7,722,123 | B2 | * | 5/2010 | Holland | 297/440.1 |
| 7,845,717 | B2 | * | 12/2010 | Leng | 297/16.1 |
| 8,764,116 | B2 | * | 7/2014 | Weber et al. | 297/461 |
| 2004/0090106 | A1 | * | 5/2004 | Senoo | 297/452.48 |

* cited by examiner

*Primary Examiner* — David R Dunn
*Assistant Examiner* — Timothy J Brindley
(74) *Attorney, Agent, or Firm* — Donald J. Ersler

(57) ABSTRACT

A universal bucket seat preferably includes a seat portion and at least three legs. The seat portion includes a recessed perimeter portion, which is formed on a top thereof. The recessed perimeter portion is sized to be received by an inner rim of an open end of a large bucket. Each leg includes a notch formed in a bottom thereof to receive an open end rim of the large bucket. The legs preferably extend from a bottom of the seat portion at an acute angle from an axis thereof. Each leg is attached to the seat portion with any suitable device, such as fasteners or substance, such as adhesive.

12 Claims, 3 Drawing Sheets

UNIVERSAL BUCKET SEAT

CROSS-REFERENCES TO RELATED APPLICATIONS

This is a non-provisional application taking priority from provisional application No. 61/888,659 filed on Oct. 9, 2013.

BACKGROUND OF THE INVENTION

1. Field of the Invention

The present invention relates generally to stools and more specifically to a universal bucket seat, which includes a seat adapted for retention in an open rim of a large bucket, such as a three gallon bucket, five gallon bucket or the like.

2. Discussion of the Prior Art

U.S. Pat. No. 4,379,587 to Duncan discloses a seat structure.

Accordingly, there is a clearly felt need in the art for a universal bucket seat, which includes a seat adapted for retention in an open rim of a large bucket.

SUMMARY OF THE INVENTION

The present invention provides a universal bucket seat, which includes a seat adapted for retention in an open rim of a large bucket. The universal bucket seat preferably includes a seat portion and at least three legs. The seat portion includes a recessed perimeter portion, which is formed around a top perimeter thereof. The recessed perimeter portion is sized to be received by an inner rim of an open end of the large bucket. Each leg includes a notch formed in a bottom thereof to receive the open end rim of the large bucket. The at least three legs preferably extend at an acute angle from an axis of the seat portion. Each leg is attached to a bottom of the seat portion with any suitable device, such as fasteners or substance, such as adhesive. However, the seat portion and the at least three legs 12 may be formed from a single piece of material, such as that achieved through rotational molding.

Accordingly, it is an object of the present invention to provide a large bucket seat, which includes a seat adapted for retention in the open rim of a large bucket.

These and additional objects, advantages, features and benefits of the present invention will become apparent from the following specification.

DETAILED DESCRIPTION OF THE PREFERRED EMBODIMENTS

Figure 1:
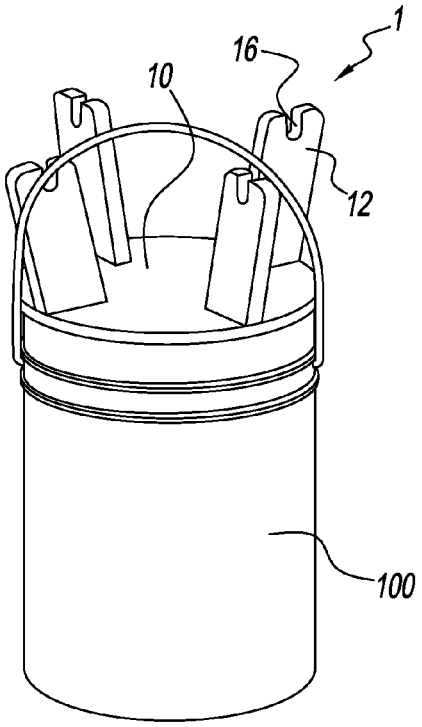
FIG. 1 is a perspective view of a seat portion of a large bucket seat retained in an inner rim of an open end of a large bucket in accordance with the present invention.
Figure 2:
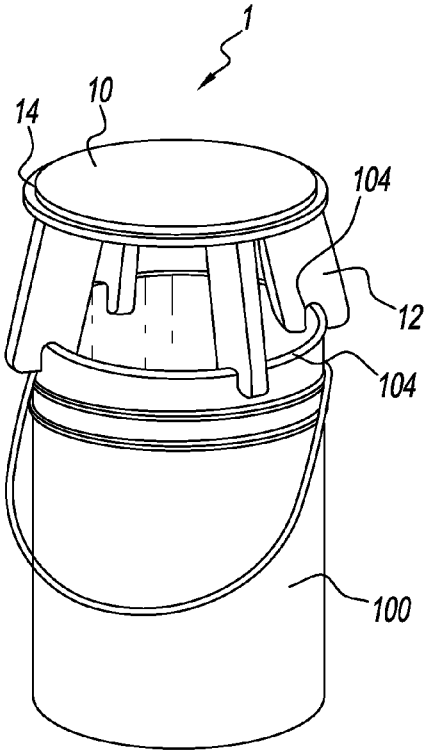
FIG. 2 is a perspective view of at least three legs of a large bucket seat retained in an inner rim of an open end of a large bucket in accordance with the present invention.
Figure 3:
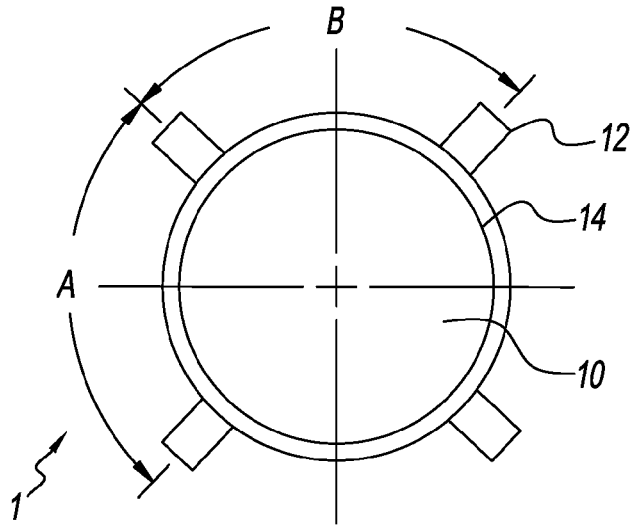
FIG. 3 is a top view of a large bucket seat in accordance with the present invention.
Figure 4:
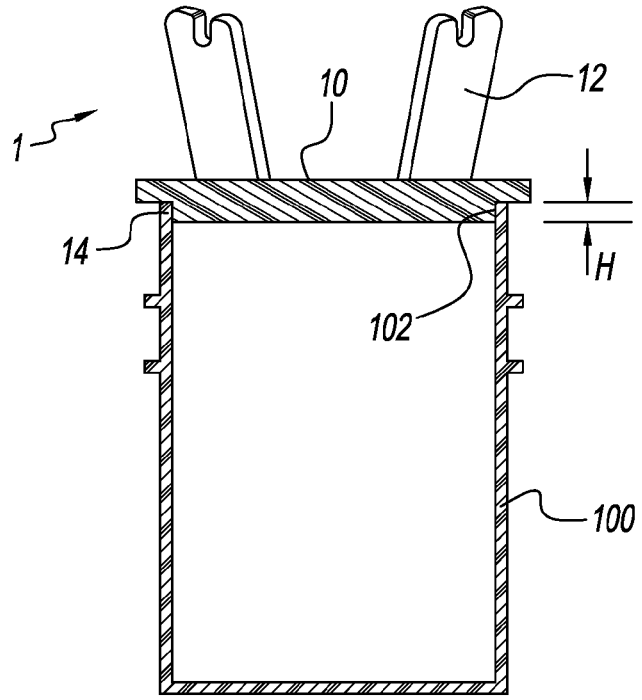
FIG. 4 is a front cross-sectional view of a seat portion of a large bucket seat retained in an inner rim of an open end of a large bucket in accordance with the present invention.
Figure 5:
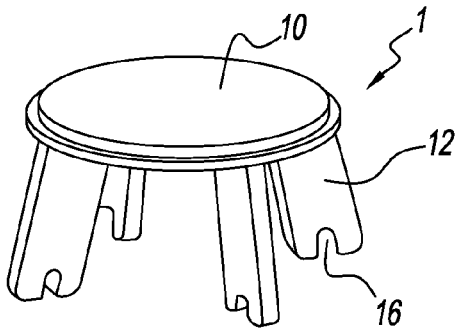
FIG. 5 is a front perspective view of a large bucket seat in accordance with the present invention.
Figure 6:
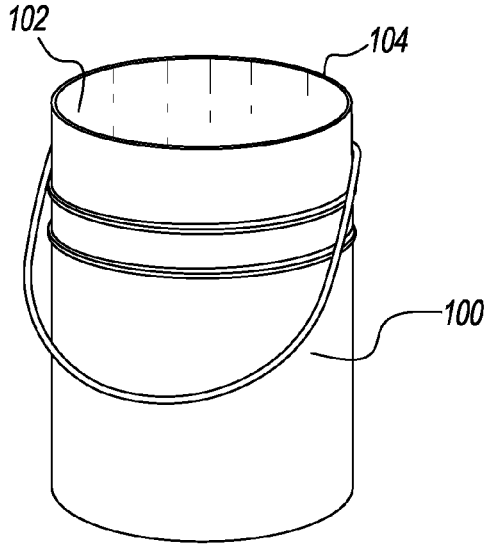
FIG. 6 is a front perspective view of a large bucket.
Figure 7:
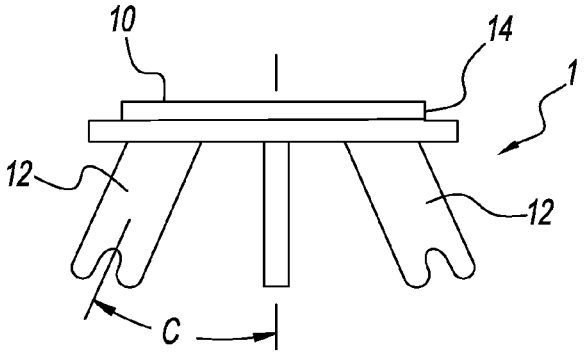
FIG. 7 is a front view of a large bucket seat in accordance with the present invention.

With reference now to the drawings, and particularly to FIG. 1, there is shown a perspective view of a seat portion 10 of a universal bucket seat 1 retained in an inner rim 102 of an open end of a large bucket 100. With reference to FIGS. 2 and 4-6, the universal bucket seat 1 preferably includes the seat portion 10 and at least three legs 12. The seat portion 10 includes a recessed perimeter portion 14, which is formed around a top perimeter thereof. The recessed perimeter portion 14 is sized to be received by the inner rim 102 of an open end of the large bucket 100. A height "H" of the recessed perimeter portion 14 is at least one tenth of a thickness of the seat portion 10. Each leg 12 includes a notch 16 formed in a bottom thereof to receive an open end rim 104 of the large bucket 100. With reference to FIG. 7, the legs 12 preferably extend at an acute angle "C" from a center axis of the seat portion. With reference to FIG. 3, the at least three legs 12 are preferably spaced equally around a perimeter of the seat portion 10, where angle "A" equals angle "B." Each leg 12 is preferably attached to a bottom of the seat portion 10 with any suitable device, such as fasteners or substance, such as adhesive. However, the seat portion 10 and the at least three legs 12 may be formed from a single piece of material, such as that achieved through rotational molding.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A universal bucket seat comprising:

a seat portion having a recessed perimeter portion formed on a top thereof, said recessed perimeter having a side wall that is substantially perpendicular to a top of said seat portion, wherein said recessed perimeter portion is sized to be received by an inner rim of an open end of a large bucket; and at least three legs extending from a bottom of said seat portion, a notch is formed in a bottom of said at least three legs, wherein said at least three notches are sized to receive an open end rim of the large bucket.

2. The universal bucket seat of claim 1 wherein:

said seat portion and said at least three legs are formed from a single piece material.

3. The universal bucket seat of claim 1 wherein:

the large bucket is one of a three gallon and a five gallon bucket.

4. The universal bucket seat of claim 1 wherein:

a height of said recessed perimeter portion is at least one tenth of a thickness of said seat portion.

5. A universal bucket seat comprising:

a seat portion having a recessed perimeter portion formed on a top thereof, said recessed perimeter having a side wall that is substantially perpendicular to a top of said seat portion, wherein said recessed perimeter portion is sized to be received by an inner rim of an open end of a large bucket; and at least three legs extending from a bottom of said seat portion, a notch is formed in a bottom of said at least three legs, said at least three legs are spaced equally around a perimeter of said seat portion, wherein said at least three notches are sized to receive an open end rim of the large bucket.

6. The universal bucket seat of claim 5 wherein:

said seat portion and said at least three legs are formed from a single piece material.

7. The universal bucket seat of claim 5 wherein:

a height of said recessed perimeter portion is at least one tenth of a thickness of said seat portion.

8. The universal bucket seat of claim 5 wherein:

the large bucket is one of a three gallon and a five gallon bucket.

9. A universal bucket seat comprising:

a seat portion having a recessed perimeter portion formed on a top thereof, wherein said recessed perimeter portion is sized to be slidably received against an inner rim of an open end of a large bucket, and at least three legs extending from a bottom of said seat portion, a notch is formed in a bottom of said at least three legs, said at least three legs extend at an acute angle from a center axis of said seat portion, wherein said at least three notches are sized to receive an open end rim of the large bucket.

10. The universal bucket seat of claim 9 wherein:

said seat portion and said at least three legs are formed from a single piece material.

11. The universal bucket seat of claim 9 wherein:

a recessed perimeter portion is formed on a top thereof, a height of said recessed perimeter portion is about at least one tenth of a thickness of said seat portion.

12. The universal bucket seat of claim 9 wherein:

the large bucket is one of a three gallon and a five gallon bucket.

* * * * *